US005470601A

United States Patent [19]

Robertson

[11] Patent Number: 5,470,601

[45] Date of Patent: Nov. 28, 1995

[54] CONTAINER FOR PREPARING AND USING ALCOHOLIC EXTRACTS

[76] Inventor: James P. Robertson, "Heath Hill", Hillside Road, Stromness, Orkney, KW16 3BS, United Kingdom

[21] Appl. No.: 819,654

[22] Filed: Jan. 13, 1992

Related U.S. Application Data

[63] Continuation of Ser. No. 598,876, Oct. 19, 1990, abandoned.

[30] Foreign Application Priority Data

Oct. 19, 1989 [GB] United Kingdom ..... 8923613

[51] Int. Cl.[6] ..... A23F 5/00; B65D 85/00

[52] U.S. Cl. ..... 426/429; 426/77; 426/80; 426/111; 426/112; 426/430

[58] Field of Search ..... 426/77, 80, 82, 426/111, 112, 113, 429, 430, 78, 431, 432, 433, 435

[56] References Cited

U.S. PATENT DOCUMENTS

| | | | |
|---|---|---|---|
| 2,123,054 | 7/1938 | Lamb et al. | 426/80 |
| 3,193,388 | 7/1965 | Conrey | 426/80 |
| 3,642,499 | 2/1972 | Castell . | |
| 4,806,369 | 2/1989 | Thompson | 426/80 |

FOREIGN PATENT DOCUMENTS

| | | |
|---|---|---|
| 58-101645 | 9/1983 | Japan . |
| 61-177977 | 12/1986 | Japan . |
| 62-36179 | 7/1987 | Japan . |

OTHER PUBLICATIONS

Rombauer, I. S. and Becker, M. R., Joy of Cooking, 1975, pp. 38–39, The Bobbs–Merrill Co., Inc.

*Primary Examiner*—Leslie A. Wong
*Attorney, Agent, or Firm*—Jones, Tullar & Cooper

[57] ABSTRACT

Alcoholic extracts of particulate solids for food or drink, and particularly of coffee grounds, are prepared in a squeezable plastics container which has a fabric filter disc across its outlet to trap the soaked grounds when the liquor extract is dispensed. A pull-off seal or cap is provided to close the container until needed. In use, liquid can be sucked back into the container by squeezing and releasing it, and used to wash a further extract from the solids.

17 Claims, 1 Drawing Sheet

CONTAINER FOR PREPARING AND USING ALCOHOLIC EXTRACTS

This application is a continuation of application Ser. No. 07/598,876, filed Oct. 19, 1990, now abandoned.

FIELD OF THE INVENTION

This invention relates to containers for preparing alcoholic extracts of substances for use in food or drink, and to methods of extraction and use of the extract.

BACKGROUND OF THE INVENTION

Alcoholic extracts of substances may find use in a variety of ways in food and drink contexts. In particular, it has been known for a long time to make whisky or liqueur coffee by soaking ground coffee in the alcoholic spirit and using the resulting liquid essence or extract as the basis of the drink. Whisky containing soluble constituents of coffee in solution is currently available in bottled form. Thus, the purchaser does not need to soak the coffee him/herself. However there is a loss of flexibility in that the relative strengths of coffee:alcohol are imposed and can be altered only by adding separate coffee or whisky to adjust the balance.

SUMMARY OF THE INVENTION

The inventor has perceived this problem, addressed the new object of giving that flexibility back to the home user, and arrived at a new idea which may have application across a wide range of other food and drink products in addition to coffee.

One aspect of the invention provides a container having a plastics body containing an alcoholic liquor and a solid, usually in sub-divided or particulate form, for extraction by the liquor;

an outlet for dispensing the liquor extract;

a filter comprised in the container whereby liquor being so dispensed passes through the filter for the filter to trap residual solids in the container; and a removable cover for closing the outlet to prevent escape of the liquor until needed.

A second aspect provides a container for preparing alcoholic extracts of a solid, for use in food or drink, having a container body for containing an alcoholic liquor and a solid to be extracted by it;

an outlet for dispensing the liquor extract;

a removable cover for closing the outlet to prevent escape of the liquor until needed, and a filter through which the liquor passes when dispensed from the outlet, to trap residual solids in the container.

It is particularly preferred that the container body be squeezable. This aids in rapid dispensing from the container and also, if as is preferred the squeezable body can restore its shape, can be used for strengthening a mixture as further described below.

The provision of such a container as a vendible product achieves the notable advantage that the purchaser is given control over the degree of extraction of the solid: this can be adjusted by the storage time, or by shaking or warming or whatever procedure is appropriate to the substance contained in it. Furthermore, where the container is squeezable it can be used like a syringe to suck liquid back through the filter into the container to rinse and/or partially re-extract the solids retained in it.

The container may be made of a flexible plastics material such as e.g. polypropylene or food-grade PVC. Desirably the material is capable of withstanding temperatures up to about 100° C., since the container may be used to suck up hot liquid e.g. from a coffee cup. A suitable shape has the outlet at the end of a relatively narrow neck portion, so that dispensing into a cup or pan is facilitated. Such a shape also helps sucking-back of liquid, for which it is necessary to immerse the outlet. The container body may be made with a bulbous shape or other shape assisting restoration of shape after squeezing. Normally the container body will have a flat surface to stand freely e.g. with the outlet uppermost.

The filter used must be capable of trapping the particular form of solids to be used in the container.

Desirably the filter material should also be resistant to damage by boiling or near-boiling aqueous liquids. A substantial porosity is preferred, since for convenience dispensing and sucking-back must be rapid, and where sucking-back is desired the back-pressure needed to pass the filter should not be greater than can be generated by the restoring of the container body shape. Generally the filter will be a thin layer. Woven mesh filters e.g. of synthetic fabric such as polyester, may be suitable. Where the manufacturing process permits, the filter could be of similar material to the rest of the container, indeed might be integral with it.

The filter should be positioned so that all dispensed liquor passes through it, e.g. directly across the outlet opening. Where the container has a neck portion it may be found convenient to locate the filter within the neck. A preferred version has a layer of filter material held over the outlet by a collar, e.g. as part of a screw, snap or crimp-on cap having a hole for the outlet.

The removable cover closes the container. It may be a conventional cap or lid. Where a filter-retaining arrangement using a collar or cap is used, the cover may fit over that.

In one preferred version the cover is a peel-off layer adhered over the outlet e.g. onto a filter-retaining collar. In that case the entire container may be of plastics material and be designed so as to be disposable. It can be sold pre-filled, used once and then discarded.

In another version the cover comprises a crimped-on cap, for example with a thin aluminium crimped member. Embodiments of these are commercially available, with pull-off plastic seals. They may be used to retain a filter disc.

In a third aspect, the invention provides a pack containing a plurality of such containers pre-filled with solids e.g. coffee, and alcoholic liquor.

In a fourth aspect, the invention provides a process for preparing an alcoholic extract of a solid for use in food or drink, in which the solid is placed in a container as described with alcoholic liquor and stored for a period to allow extraction of the solids by the liquor. Preferably the container is turned or agitated periodically.

In a further aspect of the method, when ready for use the cover is removed and the liquor extract is dispensed, preferably by squeezing the container, into the vessel in which it is to be used. For e.g. coffee, this might be a cup or pot of boiling water. Where a flexible shape-restorable container is provided, the mixture in the vessel may be sucked back into the container by immersing the outlet and releasing the squeezed container. For this it is advantageous if the container has a neck portion.

BRIEF DESCRIPTION OF THE DRAWINGS

By way of example, embodiments of the invention are now described with reference to the accompanying drawings in which.

DETAILED DESCRIPTION OF THE PREFERRED EMBODIMENTS

Figure 1:
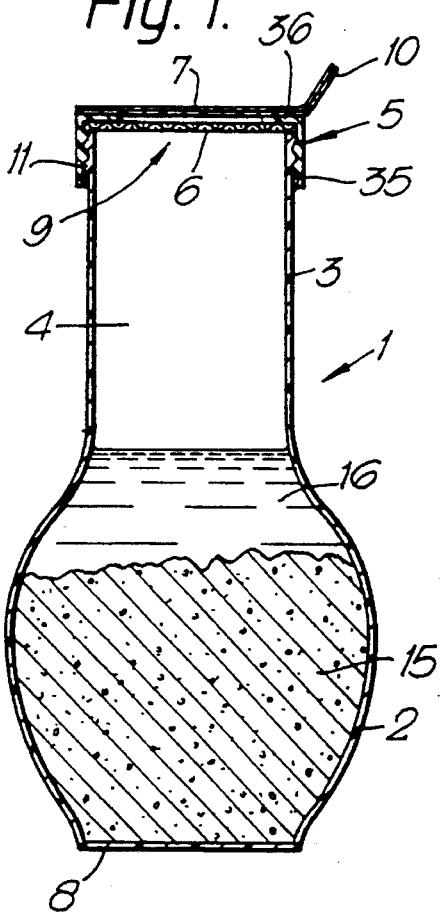
FIG. 1 is a schematic side view of a container.
Figure 2:
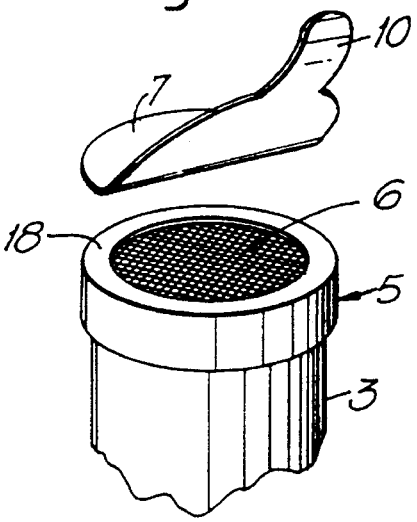
FIG. 2 is a perspective view of detail of a neck outlet of the container of FIG. 1.

With reference to FIGS. 1 and 2, a container generally indicated 1 has a body of flexible, opaque polypropylene plastics material. The body consists of a bulbous lower part 2 tapering into a substantially cylindrical upper neck 3. The lower body part 2 has a flat base 8 so that the container 1 is free-standing with the neck uppermost.

The neck 3 defines an unobstructed passage 4 from the interior of the bulbous lower part to a circular outlet 9 at the top of the neck 3.

The outside of the neck rim carries a screw thread 11. A circular polypropylene collar 5, consisting of a downward skirt 35 and an inwardly projecting flange 36, is screwed onto the neck and held there by engagement with a corresponding thread on the inside of the skirt 35. Trapped between the flange 36 of the collar 5 and the rim of the neck 3 is a circular disc 6 of light polyester mesh forming a filter.

A foil disc 7 is provided on the upper surface 18 of the collar flange 36, being held tightly onto it by a plastic lamination (not shown) over the disc 7 and heat-sealed to the side of the collar or neck.

The foil disc 7 and plastic lamination form a cover sealing the central circular aperture 9 formed by the collar. It can be removed by peeling it off, e.g. by using a projecting edge tab 10 provided for that purpose. See FIG. 2. Other forms of seal e.g. tamper-proof seals, may be used.

Contained in the container are solids 15 to be extracted, and alcoholic liquor 16 which completely immerses the solids. The solids are in ground or otherwise particulate form so that they are effectively soaked. The mesh size of the filter 6 is small enough to retain substantially all the solids 15 down to 0.1 mm. In particular embodiments it is small enough to retain coffee grounds. The mesh size chosen depends on the nature of the particulate solid, as will be appreciated.

It will be appreciated that a large number of possibilities exist for providing a filter between the contents of the container 1 and its outlet 9. The collar 5 might be a snap-on or weld-on part. Or, the filter 6 might be located further down the neck and held in place e.g. by a snap-on neck part.

Figure 4A:
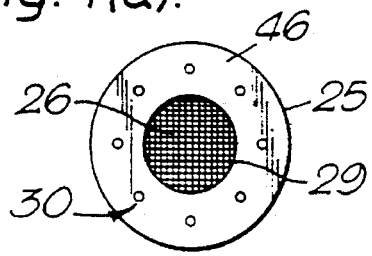
FIG. 4 and FIG. 4(a) show an alternative closure.
Figure 4:
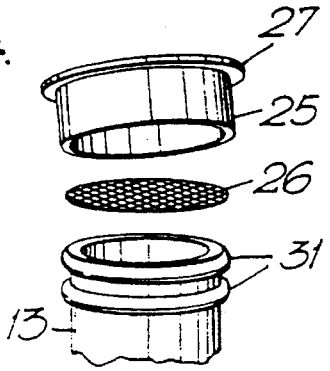

FIGS. 4 and 4(*a*) show a different form of closure. This comprises a crimpable aluminium collar 25 which fits around the outside of the container neck 13 and is crimped in a conventional way onto two axially-spaced annular retaining flanges 31 on the neck exterior. The upper edge of the aluminium collar 25 is inturned to form a flat flange 46 around a central hole 29, and this traps a woven fabric filter disc 26 against the neck edge.

On fitting, the aluminium crimp is closed off by a plastic seal cap 27 which has—in a manner known per se—plural downward projections which engage in corresponding apertures 30 around the central hole 29 of the aluminium flange.

The bottom part of the container need not be a smooth bulb shape. Other shapes may be found useful to provide a sucking-up effect as described. However it is preferred to have a body portion containing a larger part of the container volume and a neck portion of lesser volume, incorporating or carrying the filter so as to keep down the amount of filter material needed.

The embodiment described is all of low cost synthetic material and hence is extremely cheap to make; consequently it can be sold as a product to be used once and then thrown away. However, it may if desired by made more sturdy so as to be re-usable.

The contents of the container may be selected from a wide range of possible products, although use with coffee is particularly envisaged. Wherever a flavoured alcoholic essence might be useful either in drink or in food, the present system may be applicable. Examples of solids which may be used are coffee, tea, cocoa, herbs, seeds, roots, berries, fruits, sugars and dairy products (e.g. cream powder for drinks). These are preferably in particulate form.

The alcoholic (ethanolic) liquor likewise may be chosen from a wide range. For use with coffee there may be mentioned whisky, cognac, brandy and the various liqueurs commonly drunk in coffee. Other liquors may be appropriate to other solids, as will be clear to the skilled man.

The size of the container also may be varied in accordance with the intended use. For drinks, a container of a volume between 10 and 150 ml, preferably between 15 and 60 ml, and more particularly 20 to 50 ml, would be typical. Outlet size is preferably from 0.5 to 2 cm across, more particularly 1 to 1.5 cm.

Figure 3:
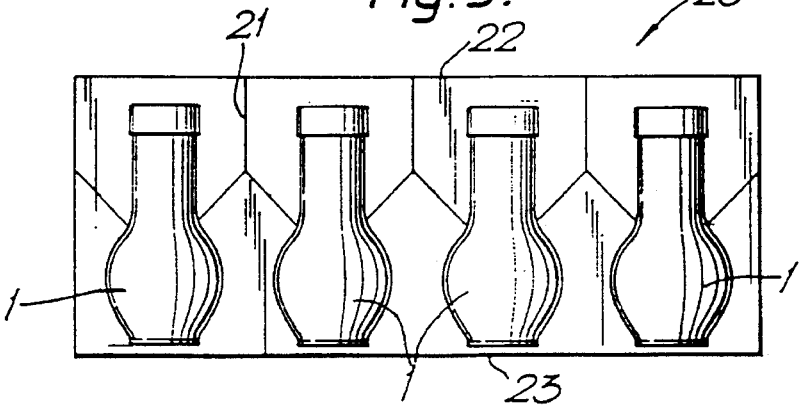
FIG. 3 is a schematic side view of several containers in a package.

A set of containers may be provided as a pack as shown in FIG. 3. The various containers 1 in the set may contain different ingredients. The packs may be sold with directions to a retailer for time of storage and optionally for turning the pack during storage, to ensure optimum maceration before the product goes on the shelf for sale to a user.

With certain products e.g. coffee with whisky or brandy, the quality of the product is improved by keeping, so the user has the option of storing the container him/herself for a further period after purchase.

EXAMPLE 5 g of ground coffee and 15 ml of 40% vol. spirit were charged into containers as described above with reference to FIG. 1, and the seals applied.

The volume of each container was 35 ml. A number of such containers 1 were put into a pack 20 (see FIG. 3) in which they were held still by retaining projections 21 between the flat top and bottom walls 22,23 of the pack. The pack was stored for a period of 10 days (7–14 days is typically suitable) with inversion every day. Daily turning is not essential but some turning does enhance the process. At the end of that period a container 1 was opened and the contents added into a cup of boiling water by squeezing the bulbous lower part 2 of the container. The coffee solids were retained in the container by the filter 6. To strengthen the coffee/alcohol/water mixture in the cup, the outlet 9 of the squeezed container 1 was immersed in the liquid and the squeeze released to suck up a volume of liquid. This was then agitated in the container to rinse out the solids, and the resulting 'secondary extract' re-dispensed into the cup.

What I claim is:

1. A method of providing an alcoholic extract for use in food or drink, comprising:

providing a resiliently squeezable plastics container having an outlet;

charging particulate extractable solids into said container;

charging alcoholic liquor into said container to wet the particulate solids;

securing a filter across the container outlet, said filter having a pore size smaller than said particulate solids;

closing the filter outlet with a closure seal to seal the alcoholic liquor and particulate solids inside the container; and allowing the particulate solids to soak in the alcoholic liquor over a period of time, to form an alcoholic extract thereof sealed in the resiliently squeezable container.

2. A method as claimed in claim 1, further comprising removing the closure seal and dispensing the liquor from the container through the outlet by squeezing the container, retaining the particulate solids in the container by the filter.

3. A method as claimed in claim 2, further comprising immersing the outlet in liquor, and releasing the squeezed container to suck liquor back into the container through the outlet and the filter.

4. A method as claimed in claim 1 in which the particulate extractable solids are selected from the group consisting of coffee, tea, cocoa, herbs, seeds, roots and fruit solids.

5. A method as claimed in claim 4 in which said solids are coffee solids, and said alcoholic liquor is selected from the group consisting of whisky, cognac and brandy.

6. A product for providing an alcoholic extract for use in food or drink, comprising:

a resiliently squeezable plastics container, said container having an outlet, and having a volume of 10 ml to 150 ml;

alcoholic liquor in the container;

alcoholically-extractable particulate solids, said solids being selected from the group consisting of coffee, tea, cocoa, herbs, seeds, roots and fruit solids, said solids soaking in said alcoholic liquor in the container to form an alcoholic extract thereof in the container;

seal closure means closing off the outlet to seal the alcoholic liquor and the soaking solids inside the container while said alcoholic extract forms; and a filter, said filter having a pore size smaller than the particle size of said solids, and being positioned to prevent escape of said solids from the container through the outlet when said seal closure means have been removed, and wherein said container is sufficiently resilient to suck liquid back through the filter into the container when the container is released after squeezing, with the outlet thereof immersed in said liquid, to contact the solids with said liquid.

7. A product as claimed in claim 6 in which said container is made of a flexible plastics material selected from the group consisting of polypropylene and food-grade PVC.

8. A product as claimed in claim 6 in which the filter comprises a woven synthetic fabric.

9. A product as claimed in claim 6 in which the filter is secured to the container at the outlet.

10. A product as claimed in claim 6 in which the container has a volume of from 15 to 60 ml.

11. A product as claimed in claim 6 in which the seal closure means comprise a foil disk heat-sealed over the outlet.

12. A product for use in preparing a flavored food or drink, said product comprising:

a flexible plastics container, said container comprising a body portion and a neck portion and having a single outlet which is provided at said neck portion;

alcoholically-extractable particulate solids in the body portion of the container, and alcoholic liquor soaking said solids to produce an alcoholic extract thereof;

pull-off closure means on the neck portion of the container, closing the outlet of the container whereby said liquor and solids are sealingly enclosed inside said container, and filter means in the neck portion of the container, for retaining the particulate solids inside the container;

said container body being squeezable whereby alcoholic extract is dispensable therefrom through said filter and said outlet by squeezing said container body portion, and said container body portion being resilient whereby liquid may be sucked back into the container, through the outlet and filter, on releasing the squeezed container body with the outlet immersed in said liquid.

13. A product as claimed in claim 12 in which said container is made of a flexible plastics material selected from the group consisting of polypropylene and food-grade PVC.

14. A product as claimed in claim 12 in which the filter comprises a woven synthetic fabric.

15. A product as claimed in claim 12 in which the filter is secured to the container at the outlet.

16. A product as claimed in claim 12 in which the container has a volume of from 15 to 60 ml.

17. A product as claimed in claim 12 in which the pull-off closure means comprise a foil disc heat-sealed over the outlet.

* * * * *